US006142879A

United States Patent [19]

Phillips

[11] Patent Number: 6,142,879

[45] Date of Patent: Nov. 7, 2000

[54] PILLOW SLIDE

[76] Inventor: Forrest B. Phillips, 145 De La Costa Ave., Santa Cruz, Calif. 95061

[21] Appl. No.: 09/243,167

[22] Filed: Feb. 2, 1999

[51] Int. Cl.[7] ..... A63G 21/00

[52] U.S. Cl. ..... 472/116; 472/90

[58] Field of Search ..... 472/116, 117, 472/89, 90; 5/413 AM, 636, 490, 925, 926, 413 R; 280/18–21; 2/69.5

[56] References Cited

U.S. PATENT DOCUMENTS

| | | | |
|---|---|---|---|
| 3,140,878 | 7/1964 | Davis | 280/18 |
| 3,290,703 | 12/1966 | Worrall | 5/490 |
| 3,639,931 | 2/1972 | McGuire | 5/413 R |
| 4,657,266 | 4/1987 | Bohme | 280/18 |
| 4,910,055 | 3/1990 | Wigutow | 5/413 R |
| 5,246,401 | 9/1993 | Boatwright | 472/116 |
| 5,557,815 | 9/1996 | Mintz et al. | 5/636 |
| 5,652,983 | 8/1997 | Kraemer | 5/639 |

*Primary Examiner*—Kien T. Nguyen
*Attorney, Agent, or Firm*—Malcolm B. Wittenberg

[57] ABSTRACT

A sliding exercise apparatus used as a recreational device. The device includes at least a pillow or a case for a pillow or similar cushioning material having top and bottom surfaces, the bottom surface of which is clad with a low friction durable coating. The pillow can be employed with any number of services similarly clad with a low friction durable coating including a sheet, blanket, sliding case or similar expedient or even a sleeping bag having the required low friction durable clad surface.

20 Claims, 5 Drawing Sheets

PILLOW SLIDE

TECHNICAL FIELD OF INVENTION

The present invention is directed to a sliding apparatus used as a recreational and exercise device. The invention includes at least one pillow or similarly padded object or a case for a pillow which has a slippery, sliding shell surface ideally suited for indoor use.

BACKGROUND OF THE INVENTION

A common problem facing virtually all parents is to find suitable entertainment for children and young adults. Without a suitable recreational outlet, children oftentimes engage in destructive pursuits not because they are particularly malicious but because of an ongoing need to fight boredom and release pent-up energy.

Further, all too often, parents find their children engaged in sedentary activity such as watching television or playing video games particularly during periods of inclement weather. Although such activity is relatively harmless, it results in little or no physical exertion and is thus not conducive to promoting physical health.

The present invention involves a sliding apparatus intended for indoor recreational use. There are certainly other devices which can be employed to create low-friction sliding surfaces. However, such apparatus generally involves the use of water or a similar expedient to lower friction and, as such, are not conducive for indoor use.

Furthermore, the prior art is devoid of teaching any sliding apparatus which is convertible from other useful objects. As will be more fully embellished below, the present apparatus creates a low friction slide from a pillow or pillow case which can be used alone or in conjunction with other sheeting material having the dual purpose of providing a nurturing sleeping environment on the one hand and a slippery sliding surface on the other.

It is thus an object of the present invention to provide a sliding apparatus used as a recreational and exercise device which can be employed indoors without the need for water or similar expedient used by the prior art.

It is yet a further object of the present invention to provide a sliding apparatus convertible from commonly used sleeping aids.

These and further objects will be more readily apparent when considering the following disclosure and appended claims.

SUMMARY OF THE INVENTION

The present invention is directed to a sliding apparatus used as a recreational device. The sliding apparatus comprises at least one pillow having top and bottom surfaces and a stuffing material. At least a bottom surface of the pillow is clad by a coating having a lower coefficient of friction and higher durability surface than the top surface of the pillow.

As an alternative embodiment, an unmodified standard pillow used to support one's head during sleeping can be converted to an appropriate sliding apparatus of the present invention by using a dedicated pillow case for this purpose. The pillow case can have a soft cotton or cotton-like composition on one side and, when inverted, present at least one surface again having a low friction, high durability coating. Suitable handles can be placed upon the pillow and/or case enabling the user to grasp the pillow and direct it accordingly.

As further embodiments, it is contemplated that a sliding apparatus produced pursuant to the following disclosure consists of the combination of sheeting material and a sled, the latter constructed as described above. The sheeting material can be in the form of a bedding sheet, blanket, comforter or case for any of these bedding items having at least one surface clad in a low friction high durable coating upon which a suitably configured sled can traverse.

As yet another embodiment, the present invention contemplates the combination of at least one sleeping bag characterized as being able to be opened on three sides to assume a substantially two-dimensional rectangular configuration and a suitable sled. One side of the sleeping bag is clad with the same low friction, durable coating as discussed above. The user of this invention will use the sled to slide along the low friction shell surface clad to at least one side of the sleeping bag as contemplated herein.

DETAILED DESCRIPTION OF THE INVENTION

As noted above, in its broadest terms, the present invention is directed to the creation of a sliding apparatus and recreational device convertible from common place sleeping expedients. Broadly, it is intended that a user of the present invention be able to employ a pillow for sleeping and then use that same pillow to create the recreational device as more fully articulated below.

Figure 1:
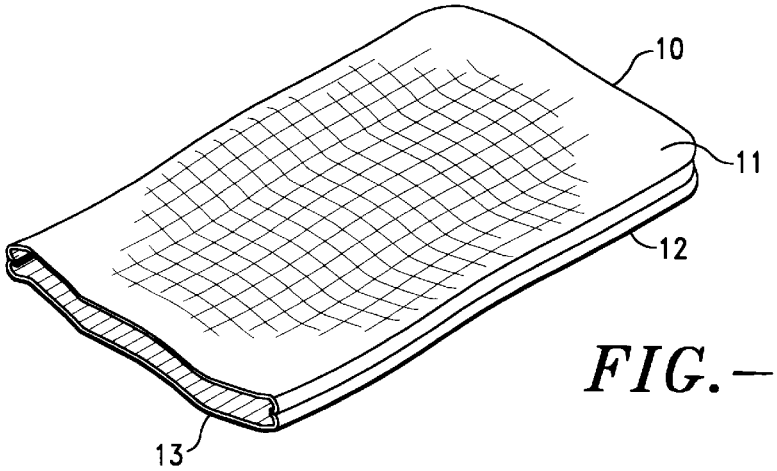
FIG. 1 is a perspective view of the pillow case produced pursuant to the present invention.
Figure 2:
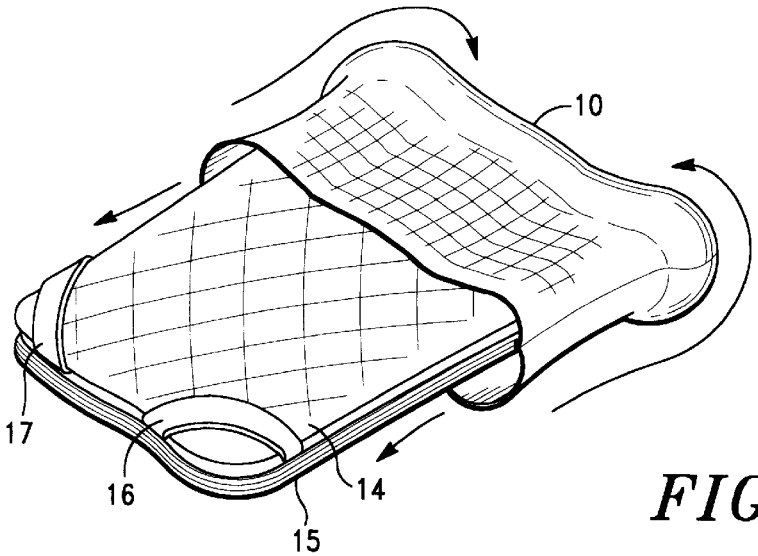
FIG. 2 is a perspective view of the pillow case of FIG. 1 turned inside out.
Figure 3:
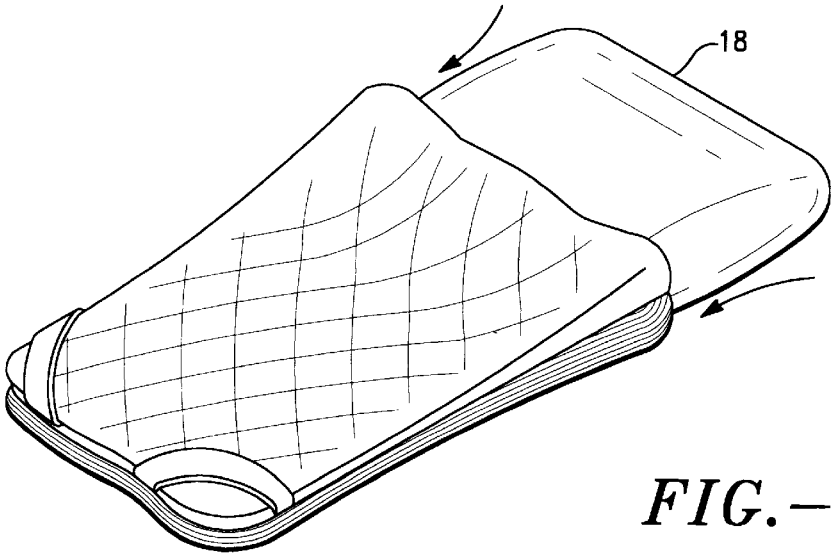
FIG. 3 is a perspective view of the inverted pillow case of FIG. 2 being fit with a commonly available sleeping pillow.

The first embodiment to practice the present invention is shown in FIGS. 1, 2 and 3. FIG. 1 depicts a reversible pillow case 10 being configured of two rectangular sheets of material 11 and 12 joined along a seam and being open on one edge at 13. When used for sleeping, it is contemplated that fabric making up rectangular sheets 11 and 12 be composed of cotton or other soft sleep-inducing fabric.

However, in producing the recreational device, it is proposed that reversible pillow case 10 be reversed as shown in FIG. 2. When reversed, an appropriate case is provided for enabling a user to use a standard bedding pillow 18 (FIG. 3) as cushioning material to produce a sled for use as shown, for example, in FIG. 13.

Turning again to FIG. 2, it is intended that surface 15 is composed of a lower friction and higher durability material than surfaces 11 and 12 of pillow case 10 prior to reversing the pillow case (FIG. 1). Surface 14 which is the surface in contact with the user when reversible pillow case 10 has been converted to a sled can also be composed of a cotton or cotton-like fabric to provide a soft surface for the user and increase friction between the sled and the user in order to lower the risk of the user slipping from the sled. To further enhance stability, pillow case 10, when reversed, is provided with handles 16 and 17 sewn into the corners of pillow case 10 enabling the user to grasp the case at its edges for stability and control. As noted previously, FIG. 3 depicts pillow 18 being fitted within reversible pillow case 10 in order to provide the necessary cushioning and third dimension enabling the user to employ pillow case 10 as a sliding apparatus. Although not shown, once pillow 18 is inserted within reversible case 10, opening 13 can be closed by Velcro, snaps, buttons, zippers or any other suitable expedient. Further, although FIG. 3 shows pillow 18 being employed as cushioning material, it is further contemplated that any other suitable bedding, such as blankets 27 (FIG. 6) can be employed as well.

Figure 4:
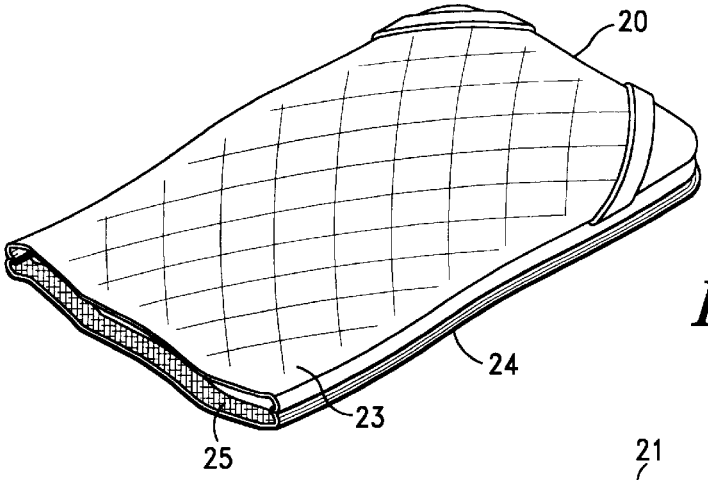
FIG. 4 is a perspective view of yet another pillow case differing from the case of FIG. 1 in that the case of FIG. 4 is not intended to be reversible.
Figure 5:
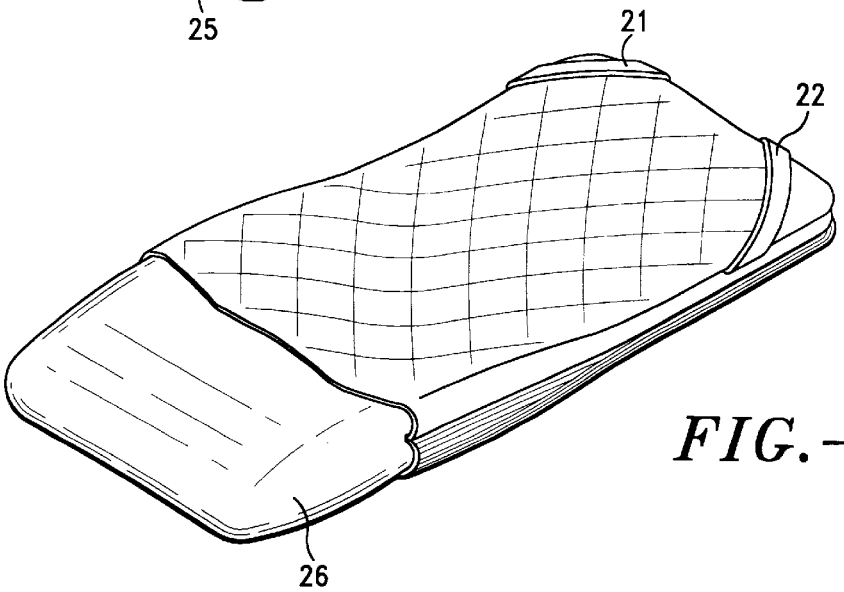
FIGS. 5 and 6 show the case of FIG. 4 being fitted with a standard sleeping pillow (FIG. 5) and blankets (FIG. 6) to provide the necessary cushioning in producing the pillow sled of the present invention.
Figure 6:
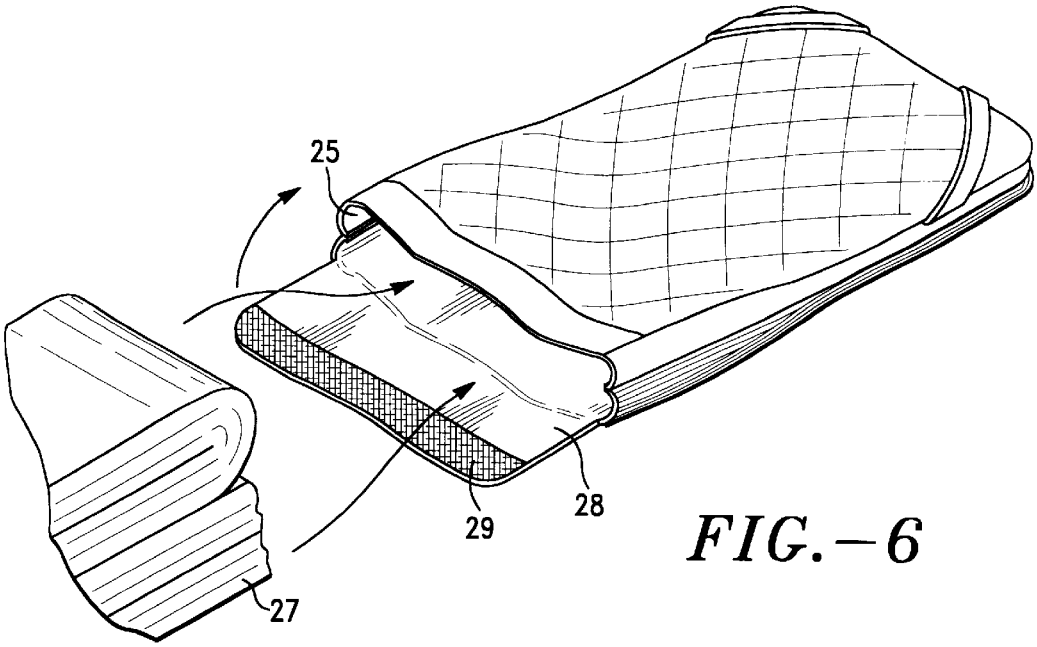

A second embodiment of the present invention is shown in FIGS. 4, 5 and 6. In this instance, pillow case 20 is not intended to be reversible. Instead, pillow 26 normally used for sleeping or bedding 27 can simply be inserted within opening 25 of pillow case 20 to again create a suitable slide. Unlike the embodiment shown in FIGS. 1–3, pillow case 20 is not intended necessarily to be employed during sleeping. It is conceivable that pillow 26 can be configured with a normal cotton case which would be removed and replaced by pillow case 20.

Turning to the specifics of FIGS. 4–6, it is noted that pillow case 20 comprises a top surface 23 and bottom surface 24 each configured in a substantially rectangular four-sided geometry having three of the four sides joined and a fourth side 25 open for receiving cushioning 26 or 27. As in the previous embodiment, at least bottom surface 24 is provided with a low friction, high durability coating. Ideally, top surface 23 is composed of cotton or similar soft fabric for contacting the torso of the user noting further that handles 21 and 22 can be sewn within the seams of pillow case 20 again for stability and control. Once suitable cushioning material such as pillow 26 or bedding 27 has been slid within pillow case 20 through opening 25, flap 29 can be closed and Velcro strip 29 used to retain the appropriate cushioning in place noting further that Velcro strip 29 can be replaced with any other suitable retaining means.

Figure 7:
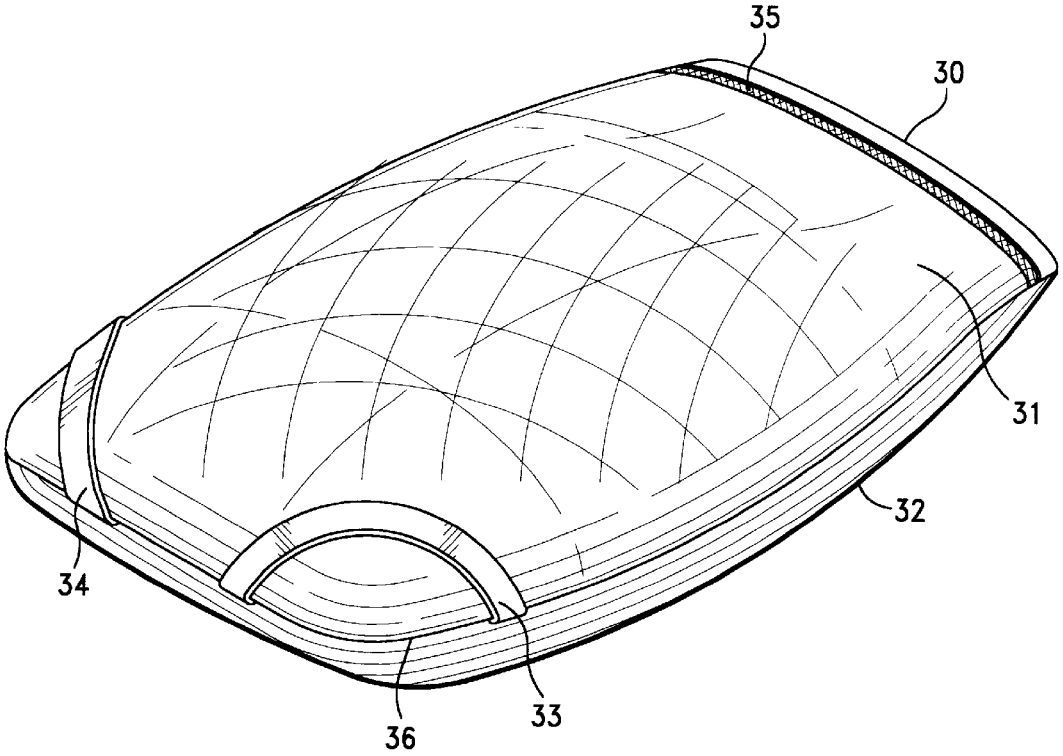
FIG. 7 is a perspective view of a fully constructed pillow slide pursuant to the present invention.

FIG. 7 shows a pillow slide constructed as a finished product. Slide 30 shown in FIG. 7 can be provided with a finished seam 35 as a stand-alone pillow or the product of FIG. 7 can be produced by practicing the invention depicted in FIGS. 1 through 6 discussed above. As a stand-alone product, FIG. 7 is provided with a low friction durable surface 32 and a cotton or cotton-like soft fabric layer 31. Between sheeting 32 and fabric layer 31, handles 33 and 34 can be sewn within seam 36. The pillow shown in FIG. 7 could thus be used as a sleeping pillow noting that a user's head would contact the soft cotton or cotton-like layer 31 with low friction durable layer 32 residing against the surface of the bedding.

In practicing the present invention, it is contemplated that any of the pillow slides shown in FIGS. 1–7 can be employed as stand-alone recreational devices. In use, one could grab the above-described handles and run with the pillow along a suitable rug, linoleum or hardwood floor and once appropriate speed is achieved, the user would fall upon the pillow and rely upon one's momentum to slide along the available flooring. The low friction, highly durable cladding described above composed of, for example, sail cloth, nylon, Dacron, polyester or Texlon would enable the user to achieve reasonable speeds at suitable durations to create an entertaining recreational device without the need for any particular companion expedient. The durable nature of the described cladding will also enable the user to use the present invention repeatedly before replacement becomes necessary.

As an enhancement of the present invention, it is contemplated that certain sheeting material be employed for contact with the pillow described above. In further keeping with the nature of the present invention, ideally, companion sheeting material should be convertible from bedding so that, like the pillow itself, the sheeting material has a dual function.

Figure 8:
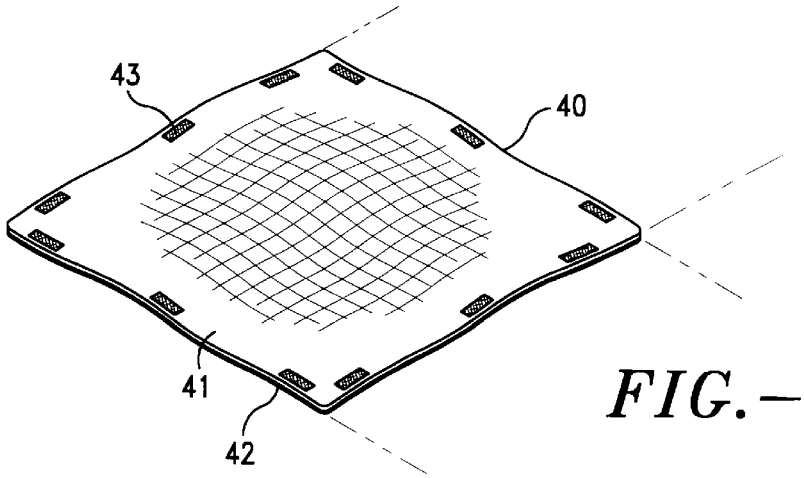
FIGS. 8 and 9 are perspective views of a single (FIG. 8) and multiply joined (FIG. 9) bed sheeting or blankets useful in practicing the present invention.

In this regard, reference is made to FIG. 8 in which sheeting 40 is shown having top and bottom surfaces 41 and 42 respectively. Sheeting 40, generally in the form of a rectangle, can be used as sheets or blankets employed as bedding having top and bottom surfaces, the bottom surface 42 being clad by a coating having the same low coefficient of friction and high durability coating as compared to the top surface which can be composed of cotton or similar fabric. When in use, it is contemplated that sheeting 40 be rolled out onto a planar surface so that low friction, high durability coating 42 be exposed while cotton fabric layer 41 provides a high friction surface for contact with suitable flooring. As such, the pillow sled of the present invention again can be employed by a user grasping the above-noted handles and taking a running start only to drop along surface 42 when sufficient speed has been achieved. In doing so, the low friction, durable coatings on sheeting material 40 and on the underside of the pillow sled come into contact with one another enabling the user to maintain speed through the user's momentum while minimizing frictional wear on the contacting surfaces.

In further enhancing one's experience in using the present invention, it is contemplated that sheeting 40 can be joined with one or more sheets 45 as shown in FIG. 8. Joining of sheets end-to-end through the use of Velcro, snaps, zippers, buttons or similar expedients, along edge 46 can be employed to produce a slide of increased length to further enhance a user's sliding experience. Similarly, sheeting can be further joined side-to-side producing a sliding surface of greater width enabling two or more users to engage in races along the above-described low friction, high durable surfaces created herein.

Figure 9:
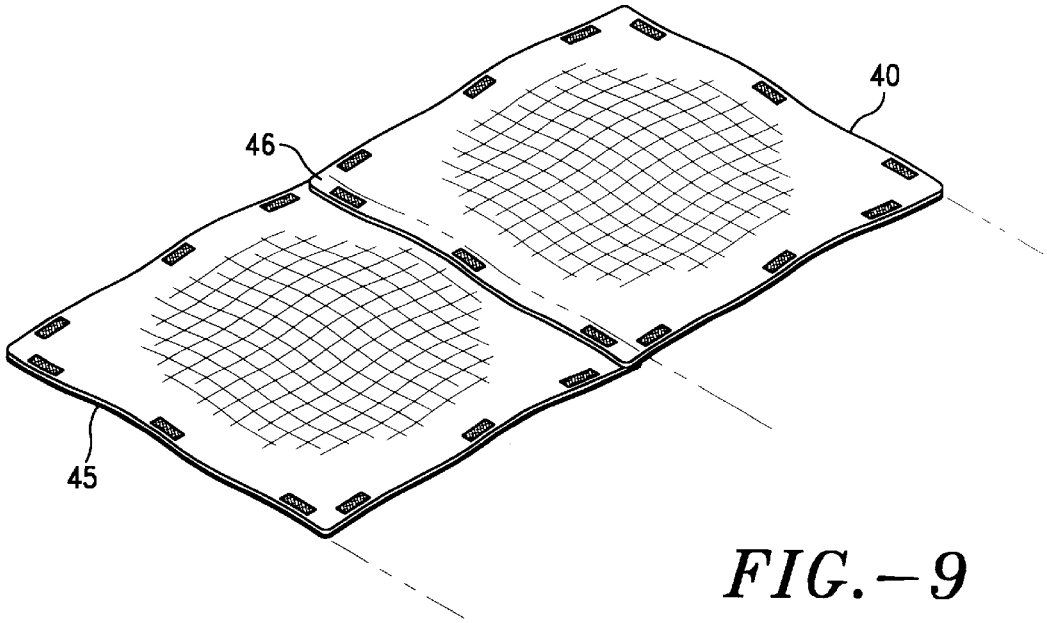

A similar product to the sheet or blanket material shown in FIGS. 8 and 9 can be constructed by cover 50. Cover 50 having a low friction durable clad surface 52 and cotton or cotton-like layer 51 are joined on three sides and open at 53 for accepting a blanket or comforter. Once the appropriate blanket or comforter has been inserted within sliding case 50, the seam at opening 53 can be closed by any common expedient such as Velcro, snaps or zippers and, as noted above with regard to the embodiments of FIGS. 8 and 9, sliding case 50 can be employed as a sliding surface either alone or in conjunction with the joining of similar sheets of materials by joining through Velcro strips 54 or the like.

As yet a further embodiment, the sliding apparatus of the present invention can be created by providing sleeping bag 60 having a soft cotton or similar lining 61 further being clad with a low friction durable shell surface 62. As was the case with previous embodiments, surface 62 can be composed of durable sail cloth or any member selected from the group consisting of nylon, Dacron, polyester or Texlon which can be clad onto a sleeping bag and create low friction durable surfaces.

Figure 12:
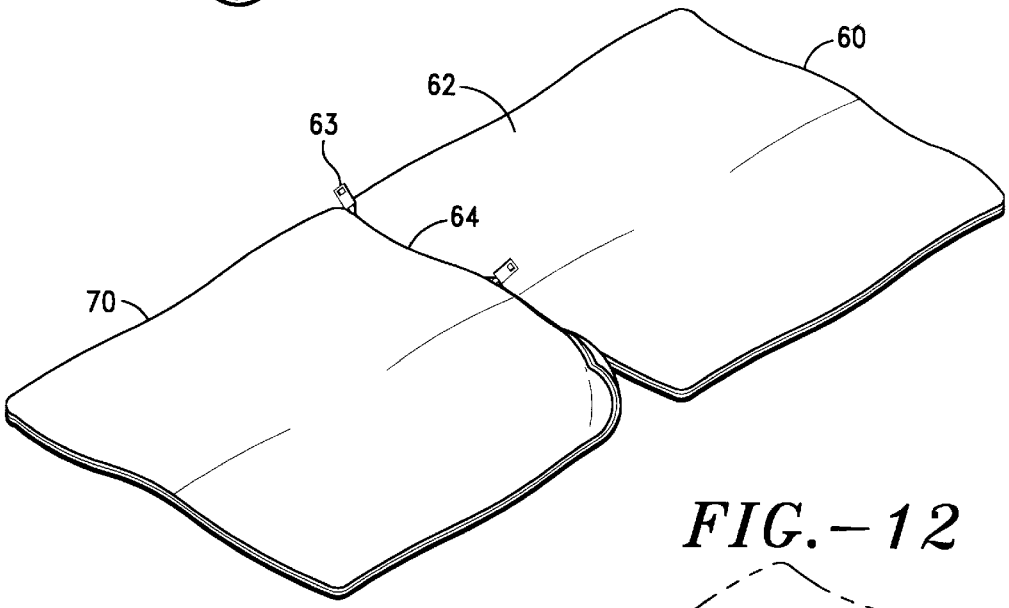
FIG. 12 shows two of the sleeping bags of FIG. 11 joined end to end to produce a slide useful in practicing the present invention.

The slide employed in practicing this embodiment can be composed of single sleeping bags 60 whereby zipper 63 can be opened on three sides creating a substantially two-dimensional rectangular configuration. As shown in FIG. 12, sleeping bag 60 and 70 can be joined by zipper 63 at common zipper boundary 64 thus extending the slide to a larger footprint. Obviously, two or more such sleeping bags can be joined in FIG. 2 adjacent one another to create a slide of extended length as well as side-by-side to create a slide of extended width. As noted with regard to the embodiment of FIG. 9, as the width increases, it is contemplated that more than one individual can employ the slide at one time thus promoting the concept of racing.

Figure 10:
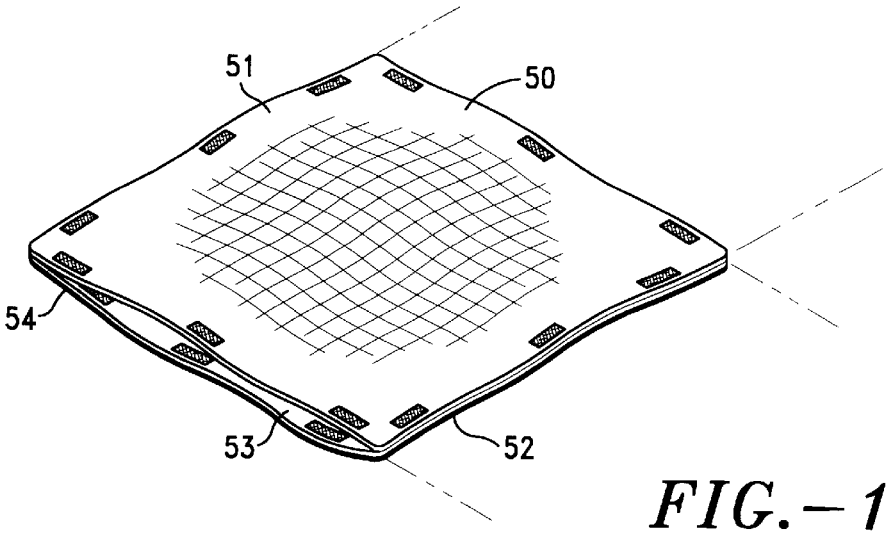
FIG. 10 is a case used to capture and encase bedding also useful in practicing the present invention.
Figure 11:
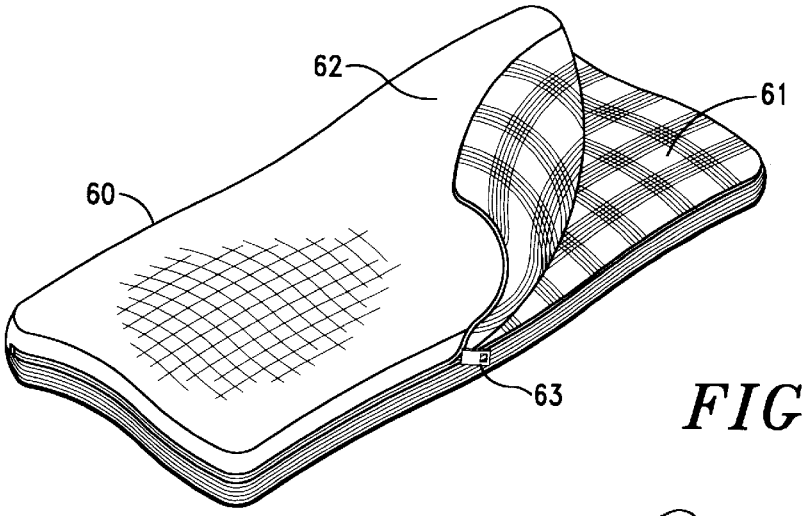
FIG. 11 is a perspective view of a sleeping bag constructed for use herein.
Figure 13:
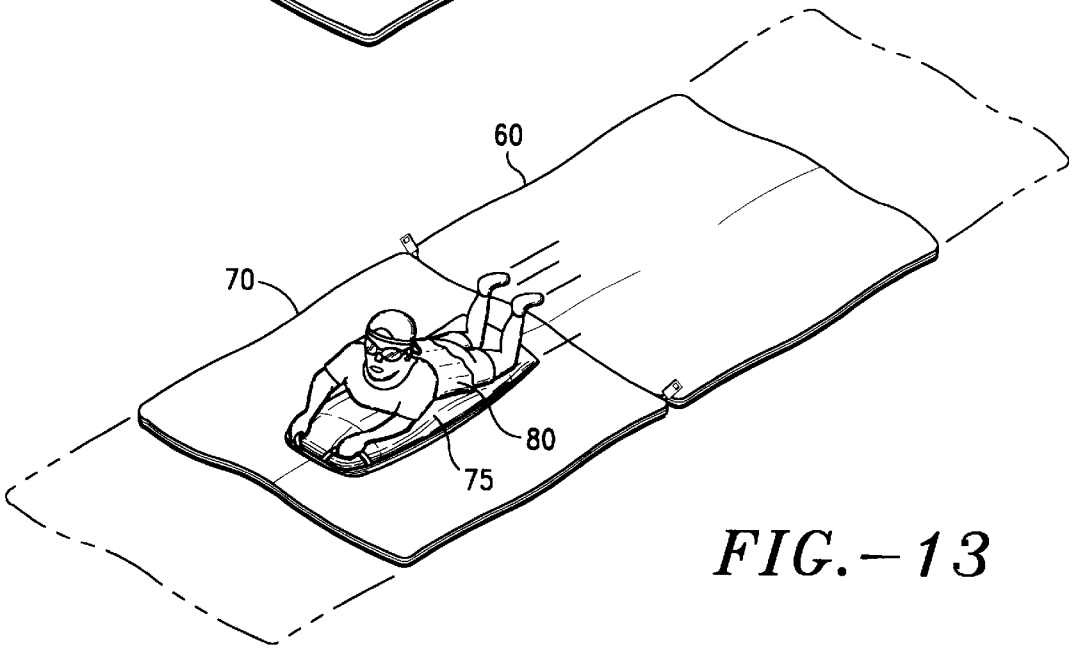
FIG. 13 is a perspective view showing a user of the present invention being supported by a pillow slide and traversing the joined sleeping bags of FIG. 12.

As shown in FIG. 13, individual 80 resting upon sled 75 is shown progressing along the low friction surface created by either the sheeting shown in FIGS. 8–10 or the sleeping bags of FIGS. 11 and 12. Obviously, sled 75 can be created in a fashion taught by FIGS. 1–7.

As was the case with the previous embodiments, it is proposed that the slide be provided with cotton or similar soft upper surface and low friction durable lower surface. With the handles sewn into the seams of the slide and by shifting one's body weight and pulling up on one or both of such handles, it is contemplated that a user can achieve a certain degree of directional control and maneuverability.

Upon reading the subject application, various alternative constructions and embodiments will become obvious to those skilled in the art. These variations are to be considered within the scope and spirit of the subject invention. The subject invention is only being limited by the claims which follow and their equivalents.

I claim:

1. A sliding exercise apparatus used as a recreational device, said sliding exercise apparatus comprising the combination of at least one piece of sheeting material, said sheeting material having a substantially rectangular geometry and further having a top surface and a bottom surface, said bottom surface being clad by a coating having a lower coefficient of friction and higher durability than said top surface and a sled sized to support a torso of a user, said sled having top and bottom surfaces, the bottom surface of which is clad with a low friction durable coating.

2. The sliding apparatus of claim 1 wherein said sheeting material is a bed sheet, blanket or cover.

3. The sliding apparatus of claim 1 wherein said bottom surface of said sheeting material and bottom surface of said sled are clad in a coating being a member selected from the group consisting of sail cloth, nylon, Dacron, polyester and Texlon.

4. The sliding apparatus of claim 1 wherein said sled is further provided with handles sized and placed upon the top surface of the sled for grasping by hands of an user.

5. The sliding apparatus of claim 4 wherein said pieces of sheeting material are attached to one another by the use of Velcro, snaps, zippers or eyelets.

6. The sliding apparatus of claim 1 wherein said recreational device comprises at least two pieces of sheeting material, each attached to an adjacent piece of sheeting material, end to end to create a slide of extended length.

7. The sliding apparatus of claim 1 wherein said recreational device comprises at least two pieces of sheeting material each attached to an adjacent piece of sheeting material, side to side, to create a slide of extended width.

8. The sliding exercise apparatus used as a recreational device, said sliding apparatus comprising the combination of at least one sleeping bag, said sleeping bag being characterized as being able to be opened on three sides to assume a substantially two-dimensional rectangular configuration, one side of which being clad in a low-friction, durable coating and a sled sized to support a torso of a user, said sled having top and bottom surfaces, the bottom surface of which is also clad with a low-friction durable coating.

9. The sliding apparatus of claim 8 wherein said sled is further provided with handles sized and placed upon the top surface of the sled for grasping by hands of said user.

10. The sliding apparatus of claim 8 wherein said low-friction durable coating comprises a member selected from the group consisting of nylon, Dacron or polyester and Texlon.

11. The sliding apparatus of claim 8 wherein said low-friction durable coating comprises sail cloth.

12. The sliding apparatus of claim 8 wherein said recreational device comprises at least two sleeping bags, each being attached to an adjacent sleeping bag, end to end, to create a slide of extended length.

13. The sliding apparatus of claim 12 wherein said sleeping bags are attached to adjacent sleeping bags by use of a zipper.

14. The sliding apparatus of claim 8 wherein said recreational device comprises at least two sleeping bags, each of which being attached to an adjacent sleeping bag, side to side, to create a slide of extended width.

15. The sliding apparatus of claim 14 wherein said sleeping bags are attached to adjacent sleeping bags by use of a zipper.

16. The sliding apparatus of claim 8 wherein said slide comprises a case stuffed with a pillow or blanket.

17. A pillow for use as a sliding exercise apparatus and recreational device, said pillow comprising a stuffing material to provide the pillow with cushioning and a covering for said stuffing material, said covering comprising a top surface and a bottom surface, said bottom surface being clad by a coating having a lower coefficient of friction and higher durability than the top surface and wherein handles are placed upon the top surface thereof.

18. A pillow for use as a sliding exercise apparatus and recreational device, said pillow comprising an outer pillow case and further comprising stuffing material to provide the pillow with cushioning and a covering for said stuffing material, said covering comprising a top surface and a bottom surface, said bottom surface being clad by a coating having a lower coefficient of friction and higher durability than the top surface of said pillow and wherein said outer pillow case comprises cotton.

19. A pillow for use as a sliding exercise apparatus and recreational device, said pillow comprising stuffing material to provide the pillow with cushioning and a covering for said stuffing material, said covering comprising a top surface and a bottom surface, said bottom surface being clad by a coating having a lower coefficient of friction and higher durability than the top surface of said pillow and wherein said top surface and bottom surface are each configured in a substantially rectangular four-sided geometry having three of the four sides joined and a fourth side open for removably receiving said cushioning, and wherein handles are placed upon the top surface thereof.

20. A reversible pillowcase having an outer surface and inner surface, said outer surface comprising of relatively soft fabric intended to support a user when sleeping and an inner surface exposed upon reversing the pillowcase, said inner surface exhibiting a lower coefficient of friction and higher durability than said outer surface and wherein handles are placed upon the inner surface thereof.

* * * * *